US005245941A

United States Patent [19]

Gattuso

[11] Patent Number: 5,245,941

[45] Date of Patent: Sep. 21, 1993

[54] APPARATUS FOR SEALING A DAMAGED VESSEL

[76] Inventor: Peter Gattuso, 41-99 Parsons Blvd., Flushing, N.Y. 11355

[21] Appl. No.: 945,685

[22] Filed: Sep. 16, 1992

[51] Int. Cl.[5] ..... B63B 43/16

[52] U.S. Cl. ..... 114/227; 114/228

[58] Field of Search ..... 114/227-229, 114/74 R; 138/89, 93, 97, 98

[56] References Cited

U.S. PATENT DOCUMENTS 3,841,256 10/1974 Etchelecou et al. ..... 114/227

FOREIGN PATENT DOCUMENTS 0628026 9/1978 U.S.S.R. ..... 114/227

0984925 1/1983 U.S.S.R. ..... 114/227

91/15396 10/1991 World Int. Prop. O. ..... 114/227

*Primary Examiner*—Edwin L. Swinehart

*Attorney, Agent, or Firm*—Collard & Roe

[57] ABSTRACT

An apparatus for sealing a hole in a ship's hull including a plug having a plurality of longitudinally extending inflatable tubes having two ends, with the tubes arranged parallel and adjacent to each other. A plug delivery device is provided for placing the tubes partially through the hole in the hull. The tubes are independently inflated so that the tubes inflate and seal the hole.

16 Claims, 7 Drawing Sheets

APPARATUS FOR SEALING A DAMAGED VESSEL

BACKGROUND OF THE INVENTION

1. Field of the Invention

The present invention relates to an apparatus for sealing the hull of a damaged vessel. More specifically, it relates to an apparatus having a plurality of inflatable tubes, which are delivered to the damaged area and are thereafter independently inflated to seal the damaged area.

2. The Prior Art

When a ship is damaged, for example by an iceberg or a reef, water is caused to flow into the ship, causing loss of life and damage to property. In the event that the ship is an oil tanker, damage to the vessel can result in the release of the ship's contents, which pollute the environment. Various attempts have been made to provide devices for closing openings in the holes of vessels, as seen in U.S. Pat. Nos. 1,260,978, 1,301,204, 3,669,055, 3,866,560 and 4,892,219. However, none of these patents disclose accurate means for transporting the apparatus to the exact location of the damage. Furthermore, these patents do not provide means for sealing a jagged or irregular opening in a vessel.

SUMMARY OF THE INVENTION

It is the therefore an object of the present invention to provide an apparatus for sealing a damaged vessel in which the apparatus can be quickly and accurately transported to the damaged area.

It is a further object of the present invention to provide an apparatus which is self-locating due to the flow of liquid, either into or out of a vessel.

It is still a further object of the present invention to provide an apparatus with a plurality of independently inflatable sealing means to fill jagged or irregularly shaped openings.

These and other related objects are achieved according to the invention by an apparatus for sealing a hole in a ship's hull, including a plug, having a plurality of longitudinally extending inflatable tubes, each having two ends. The tubes are arranged parallel and adjacent to each other. Plug delivery means are provided for placing the tubes partially through the hole in the hull. Means for independently inflating the tubes are provided, so that the tubes inflate and seal the hull. The plug further includes a cap and a plurality of check valves disposed on one end of each of said plurality of tubes. The ends of the plurality of tubes with the plurality of check valves is contained within the cap.

The plug further includes a flexible containment mesh attached to the cap and extending partly along the length of the tubes, to flexibly contain the tubes. The means for inflating includes a hose, having two ends, with one end operatively coupled to a cap. A source of compressed gas is located on a deck of the ship and is connected to the other end of the hose. The means for inflating pumps compressed gas through the hose into the cap, from which the compressed gas then passes through the check valves independently into the tubes.

The plug delivery means includes a conically shaped folding pilot member connected to the end of the tubes opposite the plurality of the check valves. The folding pilot member includes a plurality of longitudinally extending plates, flexibly drawn together. The folding pilot member is deployed in the vicinity of the hole and is dragged through the hole. The plug delivery means further includes a mobil probe having an axle and a pair of wheels mounted on the axle. The plug is removably attached to the probe. The probe wheels roll along the ship's hull to deploy the folding pilot member in the vicinity of the hull. The plug delivery means further includes a pair of reversible motors coupled to the pair of wheels. A light source, video camera and an electric/control line coupled to the mobil probe. The electric/control line provides power and control of the light source, video camera and the pair of reversible motors. The electric/control line further transmits a video signal from the video camera to the deck of the ship. The pair of wheels includes magnetic rims for securing the mobil probe to the metal hull of the ship, as the motors transport the mobile probe along the hull.

The plug further includes a liquid absorbing material disposed between the plurality of tubes. The liquid absorbing material expands upon exposure to liquid, to fill interstices between the tubes as the tubes are inflated. A mobil cart is provided having a power source and a control source located on the deck of the ship for storing the plug, the plug delivery means and the means for inflating when not in use. The mobil cart being transportable to a location on the deck, generally above the hull, for deploying the plug and the plug delivery means, in the vicinity of the hull. The mobil cart further houses a source of compressed gas and a power source and control source coupled to the electric/control line.

In an alternate embodiment of the invention, the plug delivery means includes a longitudinally extending post disposed between the plurality of tubes, having a pointed tip at one end thereof and a handle at the other end. The handle guides the tip through the hole to create an opening for placing the tubes partially through the hole. The handle includes a hollow tube and the post has a flange at one end opposite the tip. The post is slidingly disposed between the hollow tube with the flange engaging the hollow tube to prevent removal of the post from the handle. The handle slid along the tube in a direction away from the tip and then slid along in the opposite direction to hammer the tip through the hole.

The plug further includes a cap and a plurality of check valves disposed on one end of each of the plurality of tubes. The ends of the plurality of tubes with the plurality of check valves being contained within the cap. The plug further includes a flexible containment mesh attached to the cap and extending along the length of the plurality of tubes to flexibly contain the plurality of tubes. The means for inflating includes a hose, having two ends, with one end operatively coupled to the cap and a source of compressed gas, located on a deck of the ship, connected to the other end of the hose. The means for inflating pumps compressed gas through the hose into the cap. The compressed gas then passes through the check valves independently into the plurality of tubes.

BRIEF DESCRIPTION OF THE DRAWINGS

Other objects and features of the present invention will become apparent from the following detailed description considered in connection with the accompanying drawings which discloses several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1A:
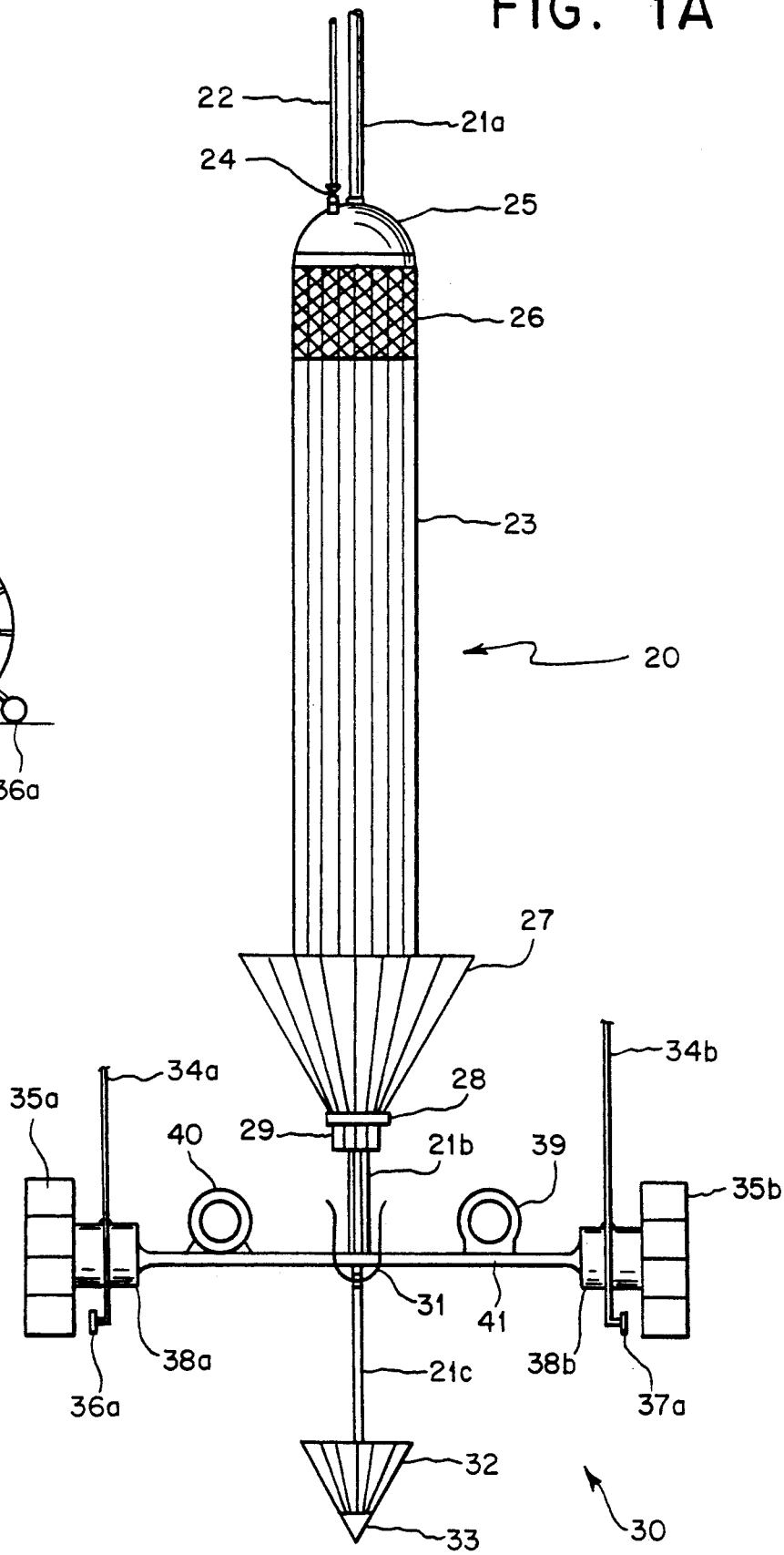
FIG. 1*a* is a front side elevational view of the probe and plug according to the invention.
Figure 1B:
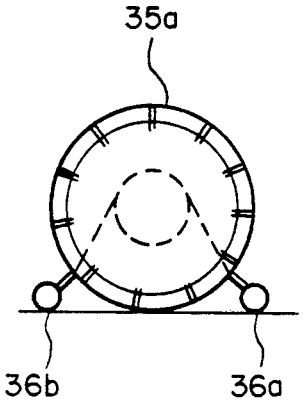
FIG. 1*b* is a left side elevational view of the probe.

Turning now in detail to the drawings and in particular FIGS. 1*a* and 1*b*, there is shown a plug 20 and a probe 30. Plug 20 is retained by a cable 21*a*, for example, a fiber glass cord. A line 22 serves as an air line to inflate a plurality of rubber tubes 23 through a valve 24. Valve 24 is coupled to a cap 25, for example, made of stainless steel. As a continuation of cap 25, wire mesh 26 is provided to hold the upper sections of rubber tubes 23 and prevent them from inflating.

At the lower end of rubber tubes 23 is a folding pilot 27, a ring 28 and end cap 29 to hold the bottom ends of rubber tubes 23 securely closed and provide a mount for folding pilot 27. Folding pilot 27, ring 28 and end cap 29 are made of a suitable metal, for example, steel. Extending below end cap 29 is cable 21*b* on which is attached a hook 31, which attaches onto probe 30. A further section of cable 21*c* extends down to an initial folding pilot 32 having a weighted tip 33.

Figure 3:
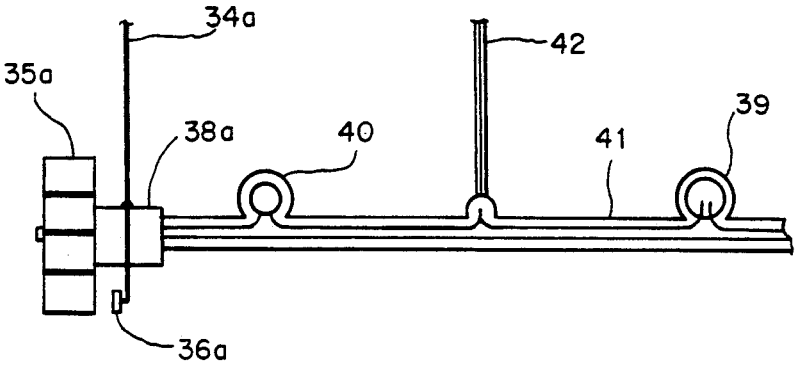
FIG. 3 is an enlarged front side elevational view of the probe of FIG. 1*a*.

Probe 30 includes guidelines 34*a* and 34*b* which extend up to the surface of the ship. At either end of probe 30 are wheels 35*a* and 35*b*, which are made of plastic with magnetic rims. Wheels 35*a* and 35*b* will magnetically hold onto the metal hull of a ship as probe 30 and plug 20 are lowered to the damaged area. Associated with wheel 35*a* is a pair of guide wheels 36*a* and 36*b*. Wheel 35*b* has associated with it an additional pair of guide wheels 37*a* and 37*b*. Guide wheels 36 and 37 serve to stabilize the probe against the hull. Wheels 35*a* and 35*b* each have a motor 38*a* and 38*b* associated therewith. Motors 38*a* and 38*b* are preferably reversible electric motors which are powered by electric/control lines 42 (see FIG. 3). In order to more accurately guide plug 20 to the damaged area, a lamp 39 and video camera 40 are attached to an axis 41 of probe 30. Lamp 39 and video camera 40 would also be powered through electric/control lines 42, and the video signal captured by video camera 40 would be transmitted above deck through electric/control lines 42. Wheels 35*a* and 35*b*, guide wheels 36*a* and 36*b*, 37*a* and 37*b*, motors 38*a* and 38*b*, lamp 39 and video camera 40 are all supported by axis 41. Lamp 39 and video camera 40 may be fixed on axis 41 or may be independently or jointly movable by commands from on board operators.

Figure 2B:
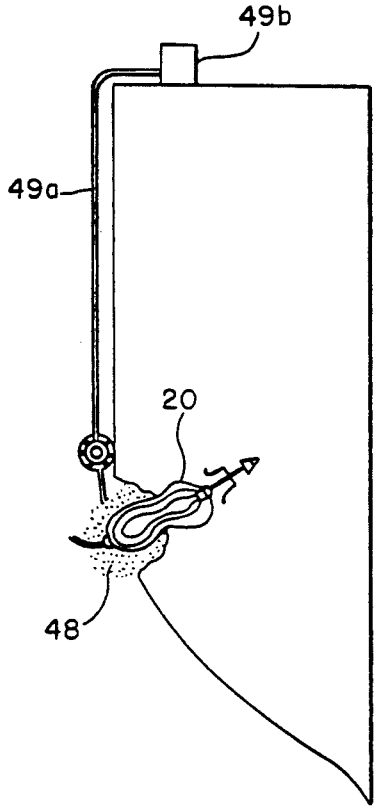
FIG. 2*b* is a cross-sectional view similar to FIG. 2*a*, with additional sealing material pumped into the vicinity of the hole.
Figure 2A:
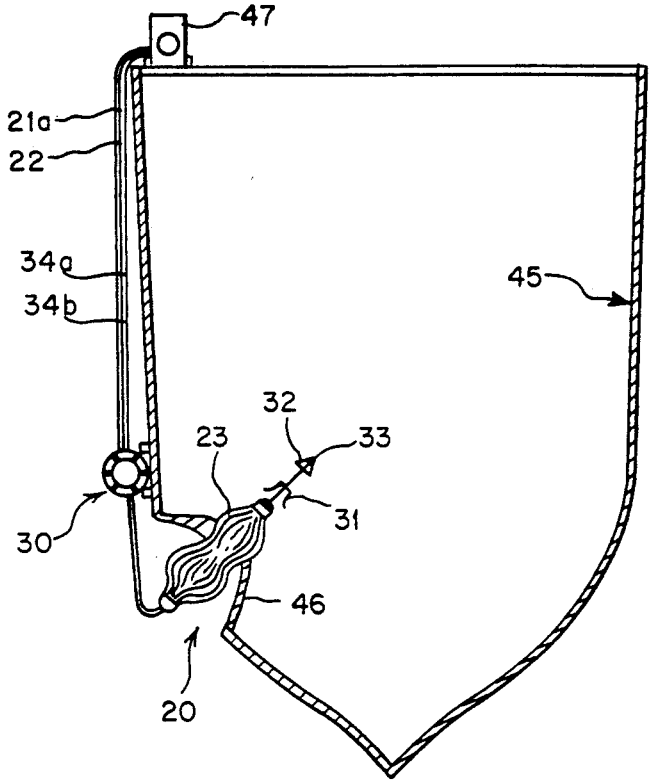
FIG. 2*a* is a cross-sectional view of a damaged hull sealed by the plug of FIG. 1*a*.

FIG. 2*a* shows a ship 45 having a damaged section of hull 46. A cart 47 resides on the deck of ship 45. Plug 20 and probe 30 are stored in cart 47 and can be deployed at any point along the length of ship 45. Probe 30 has lowered plug 20 into the vicinity of damaged hole 46, after which weighted tip 33 and initial folding pilot 32 were forced through the damaged hull section 46 by the inrush of water. Plug 20 is attached to probe 30 in such a way that as the inrush of water begins to pull, folding pilot 32, hook 31 can easily release from axis 41. Hook 31 keeps plug 20 attached to probe 30 as probe 30 pulls probe 20 down. However, once plug 20 experiences a downward force due to the rush of water, hook 31 can simply be released without outside intervention and without tangling of cables.

Once plug 20 is approximately half way inserted into the damaged hull section 46, cable 21*a* holds it in place while compressed gas is pumped through line 22 to inflate the plurality of rubber tubes 23. Probe 30 remains in place so that lamp 39 and video camera 40 can monitor the progress as rubber tubes 23 are inflated. Power for lamp 39 and video camera 40 is provided through electric/control lines 42. In addition, the video signal from video camera 40 is sent above board through electric and control lines 42, which run through axis 41 (see FIG. 3). FIG. 2*b* shows plug 20 in place and partially inflated. Sealing material 48, which is made of, for example, small fibers which can be mixed with magnetic fibers, is pumped through a large diameter hose 49*a* from an on-board tank 49*b*. Once plug 20 is in place, hose 49*a* is lowered to the vicinity of plug 20 and sealing material 48 is pumped under pressure to fill any remaining spaces.

Figure 4A:
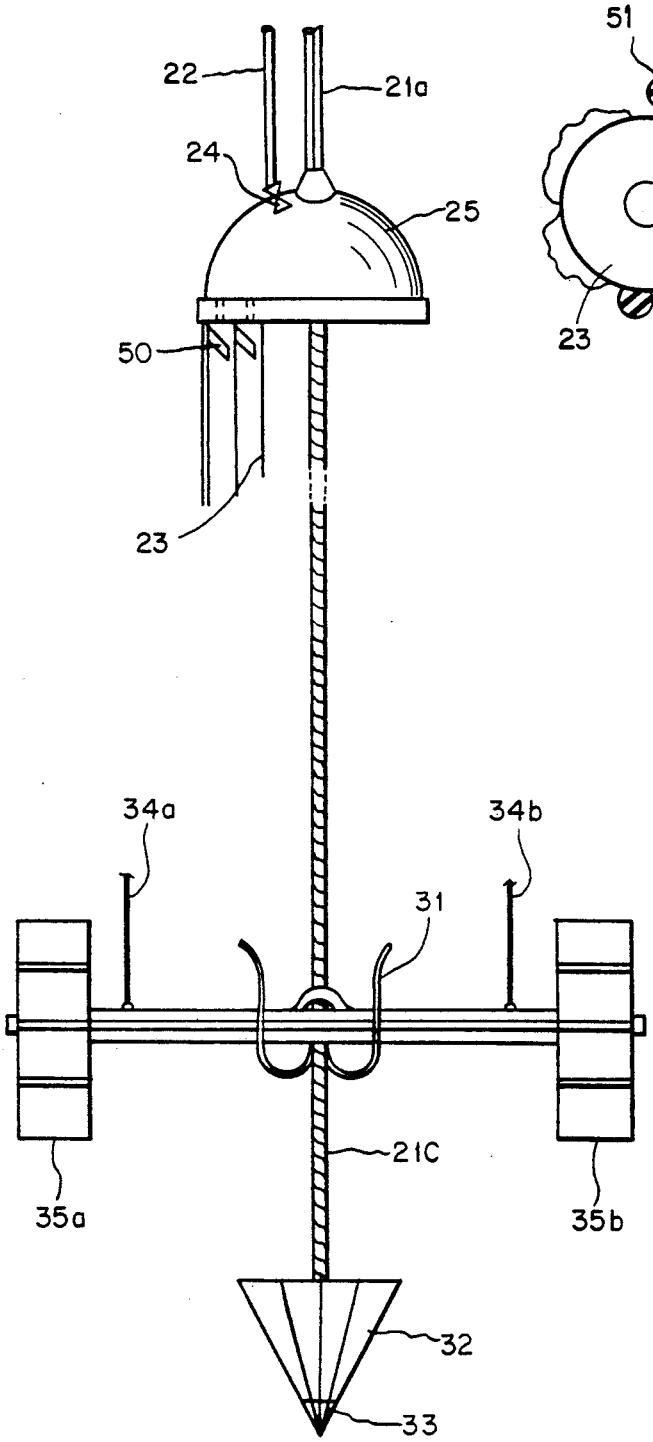
FIG. 4*a* is a front-side elevational view in part-section of the probe and plug.
Figure 4C:
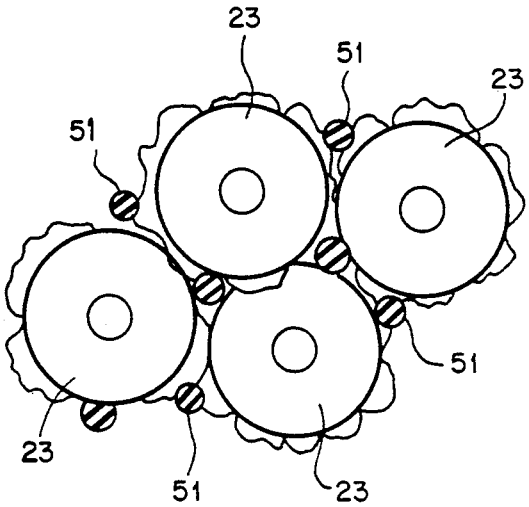
FIG. 4*c* is a cross-sectional view taken along the line 4*c*—4*c* from FIG. 4*b*.
Figure 4B:
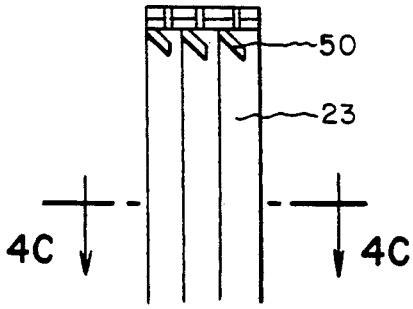
FIG. 4*b* is a detailed front-side elevational view showing the check valves of the tubes.
Figure 4D:
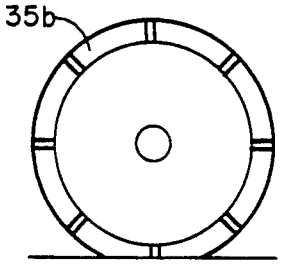
FIG. 4*d* is a right side elevational view of the probe.
Figure 5A:
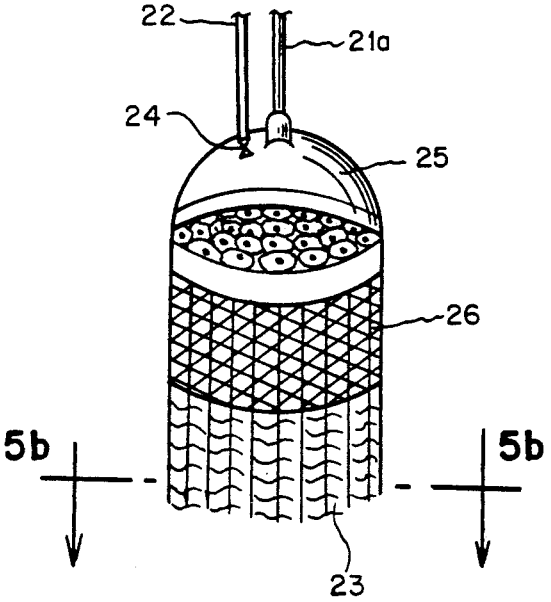
FIG. 5*a* is a detailed view of the tubes of the plug.
Figure 5B:
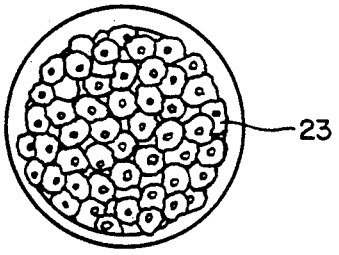
FIG. 5*b* is a cross-sectional view taking along the line 5*b*—5*b* from FIG. 5*a*.
Figure 5C:
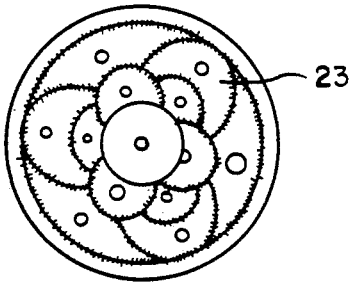
FIG. 5*c* is a cross-sectional view of an alternate embodiment of the tubes.

FIGS. 4*a* and 4*b* show a detailed view of the top portion of rubber tubes 23. Each individual tube contains a check valve 50, which allows compressed gas to independently flow from cap 25 into the individual rubber tubes 23. FIG. 4*c* is a cross-section of rubber tubes 23 showing filler material 51 interspersed between individual rubber tubes 23. FIG. 4*d* shows wheel 35*b*. FIGS. 5*a* and 5*b* show cap 25 with a complete array of rubber tubes 23. FIG. 5*c* is an alternate embodiment of rubber tubes 23 from FIG. 5*b*, showing non-circular tubes which allow for tighter packing.

Figure 6:
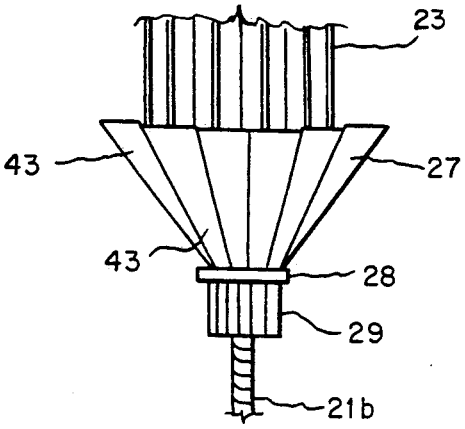
FIG. 6 is a detailed view of the folding pilot member of the plug.
Figure 7:
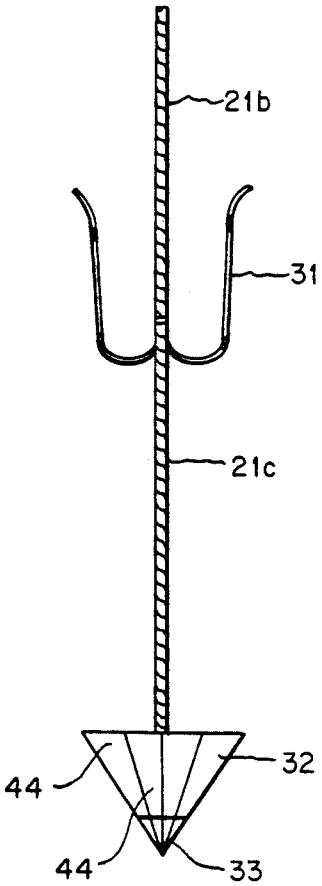
FIG. 7 is a detailed view of the hook and tip of the plug.

FIGS. 6 and 7 show the lower portion of plug 20 including folding pilot 27, ring 28, end cap 29 and cable 21*b*, extending from the bottom thereof. FIG. 7 shows W-shaped hook 31 which is connected to initial folding pilot 32 and weighted tip 33 by cable 21*c*. The folding pilots are generally cone-shaped and allow a flow of water to enter the open end of the cone, e.g. the end of pilot 32 where cable 21*c* enters, and propel the pilot through the water with its narrow end first.

The folding pilots are made from longitudinally extending plates 43 and 44 which are pivotally attached at the narrow end of the cone, e.g. at ring 28 for folding pilot 27 and at weighted tip 33 for folding pilot 32. Plates 43 are flexibly attached to each other and may fold in, like an umbrella, against tubes 23 in an overlapping manner when pilot 27 passes through a narrow opening, e.g. a hole in the hull of a ship. Similarly, plates 44 would fold in against cable 21*c* in an overlapping manner. Once through the narrow opening, the continued flow of water, or other liquid, would enter the open end of the pilots and flex the plates to their fully opened position, as seen in FIGS. 6 and 7. The pilots would continue to be propelled in the direction of their narrow tip until tubes 23 are approximately midway through the hole. By knowing the height of the ship, it can be determined when tubes 23 are in place to begin inflating them.

Figure 8:
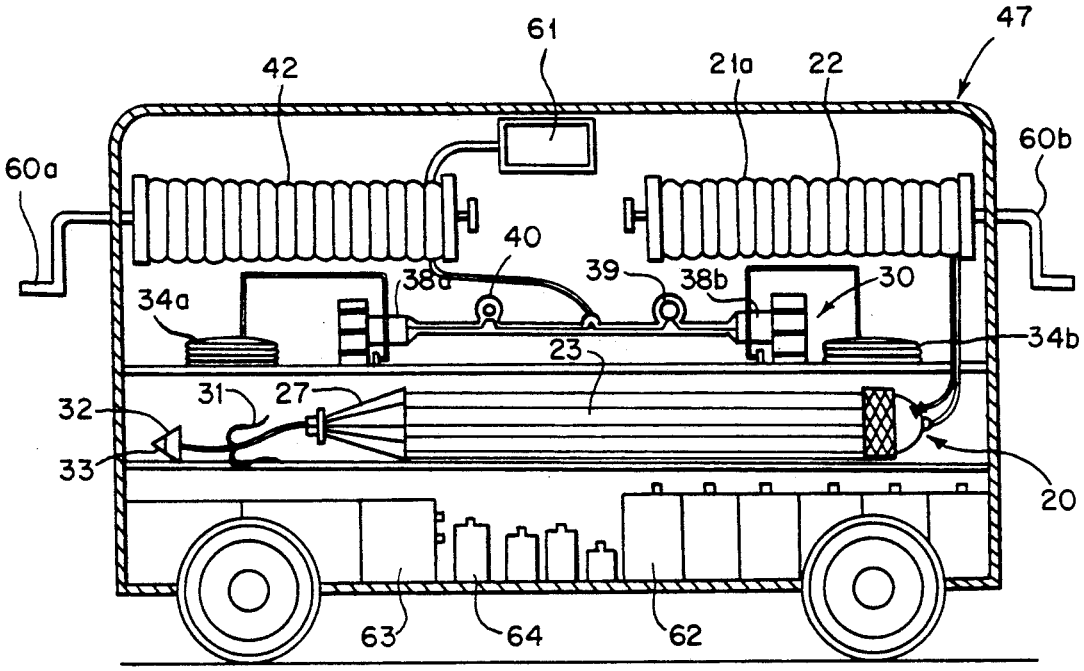
FIG. 8 is a front-side elevational view of a mobil cart for storing the probe and plug.

FIG. 8 shows mobil cart 47 which houses plug 20 and probe 30 along with all of the guidance and control systems. The cart is equipped with handcranks 60*a* and 60*b* on which cable 21*a*, line 22 and electric/control lines 42 are wound. The cart may also be equipped with a monitor screen 61 to allow workers to display the video signal from video camera 40. A bank of batteries 62 or a gasoline engine 63 are provided to power lamp 39, the video equipment and motors 38*a* and *b*. Gas engine 63 and they also operate as a compressor to fill rubber tubes 23. Compressed 64 may also be stored within mobil cart 47 for filling rubber tubes 23.

Figure 9:
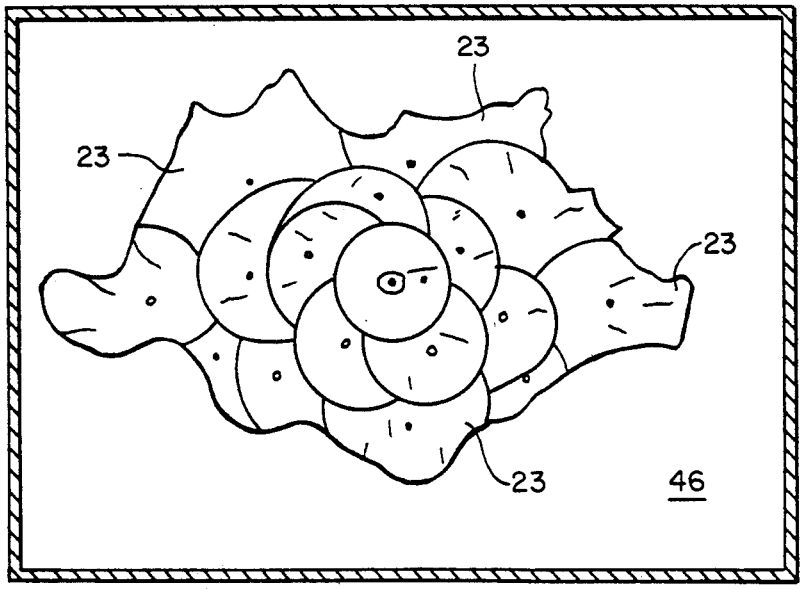
FIG. 9 is a detailed view of the plug sealing a hole in the side of a vessel.
Figure 10:
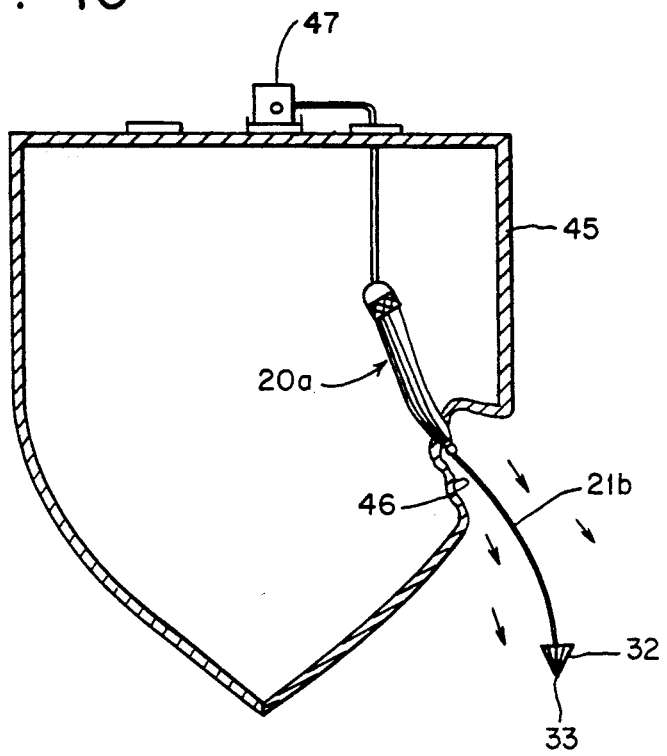
FIG. 10 is a cross-sectional view showing the plug sealing a hole in an oil tanker.
Figure 11:
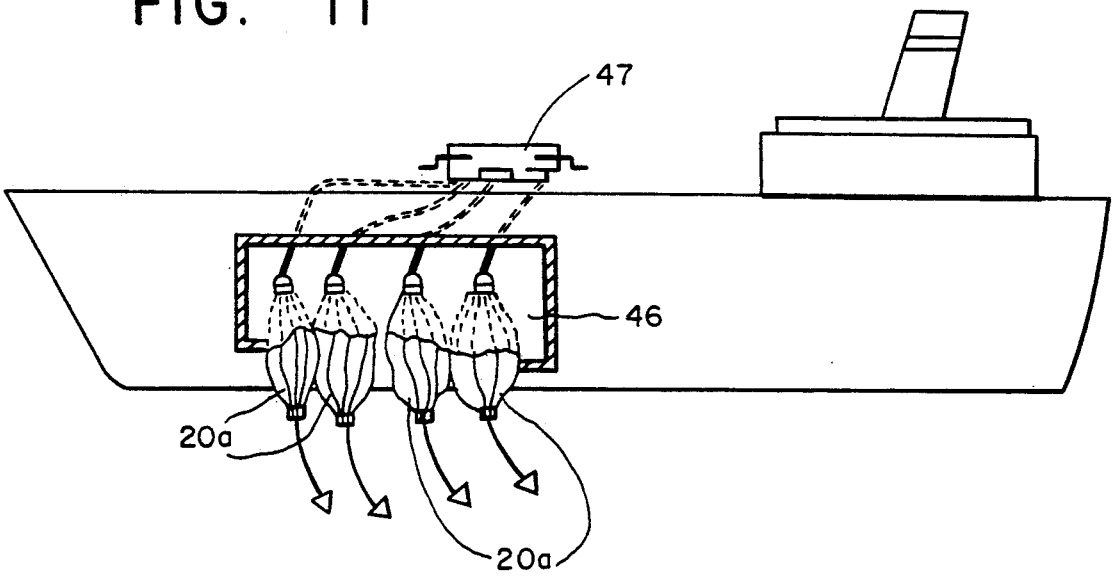
FIG. 11 is a side elevational view showing several plugs cooperatively sealing a large hole in a damaged vessel.
Figure 12A:
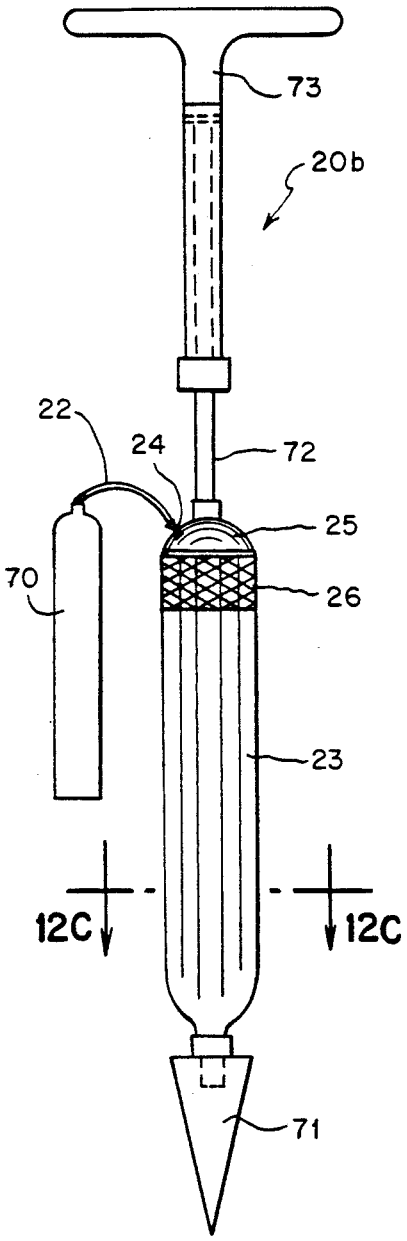
FIG. 12*a* is a side-elevational view of a hand held plug according to the invention.
Figure 12C:
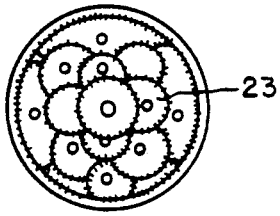
FIG. 12*c* is a cross-sectional view taken along the line 12*c*—12*c* from FIG. 12*a*.
Figure 12D:
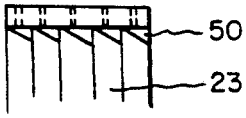
FIG. 12*d* is a detailed view of the check valves of the hand held probe.
Figure 12B:
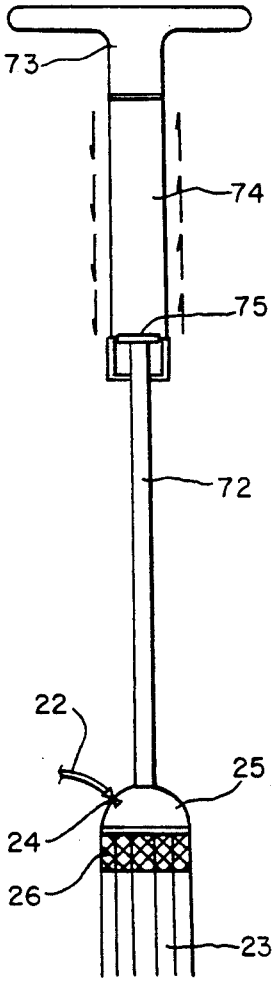
FIG. 12*b* is a cross-sectional view of the handle of the hand held plug.
Figure 12E:
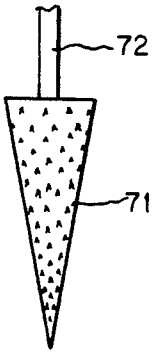
FIG. 12*e* is a detailed view of the point of the hand held probe.
Figure 12F:
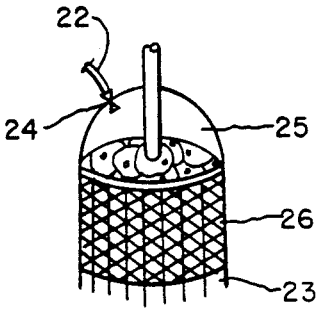
FIG. 12*f* is a detailed view of the filler cap of the hand held plug.

FIG. 9 shows rubber tubes 23 filling a ragged hole in damaged hull 46. FIGS. 10 and 11 show an alternate embodiment of the invention to be used on liquid carrying ships 45, for example, oil tankers. Plug 20*a* is self-locating and does not include hook 31. Probe 20*a* is lowered into the cargo-carrying tank where pilot 32 and weighted tip 33 are drawn through the opening in damaged hull 46 by the outrush of liquid. In the event that damaged hull 46 contains a long rupture in the hull, multiple plugs 20*a* can be used one next to the other to completely fill the space, as shown in FIG. 11.

FIGS. 12*a*–12*f* show a further embodiment according to the invention in the form of a hand-operated plug 20*b*. Hand-operated 20*c* also includes rubber tubes 23, a cap 25 and line 22 connected to a source 70 of compressed gas. The hand-operated plug 20*b* is designed for small boats, for example, pleasure boats, such as sailboats and motorboats. The lower portion of plug 20*b* includes an arrow shaped tip 71. Tip 71 is made of metal, for example, having rough edges like a wood file. Tip 71 is designed to easily penetrate a wood or fiber glass hull to enlarge the opening and guide rubber tubes 23 through the opening. The upper end of plug 20*b* includes a post 72, which extends from a handle 73 through the center of rubber tubes 23 to tip 71. Handle 73 has a hollowed-out portion 74 to receive the upper end of post 72, which is provided with a flange 75. Handle 73 can be moved up and down along post 72 to provide a hammer action against flange 75 to force tip 71 through the opening.

Once the vessel has reached a drydock or is out of the water, tubes 23 may be individually punctured and deflated. Plug 20 can then be removed from the vessel so repairs can proceed. Since the tubes are flexible there is only a minimal chance that they would cause additional damage to the vessel.

While several embodiments of the present invention have been shown and described, it is to be understood that many changes and modifications may be made thereunto without departing from the spirit and scope of the invention as defined in the appended claims.

What is claimed is:

1. An apparatus for sealing a hole in a ship's hull comprising:

a plug having a plurality of longitudinally-extending inflatable tubes, each having two ends, said tubes being arranged parallel and adjacent to each other, said plug including a cap and a plurality of check valves disposed on one end of each of said plurality of tubes, the ends of said plurality of tubes with said plurality of check valves is contained within said cap;

plug delivery means for placing said tubes partially through the hole in the hull; and means for independently inflating said tubes so that said tubes inflate and seal the hole.

2. The apparatus for sealing a hole according to claim 1, wherein said plug further includes a flexible containment mesh attached to said cap and extending along the length of said tubes to flexibly contain said tubes.

3. The apparatus for sealing a hole according to claim 2, wherein said means for inflating includes a hose having two ends with one end operatively coupled to said cap, and a source of compressed gas, located on a deck of the ship, connected to the other end of said hose, wherein said means for inflating pumps compressed gas through said hose into said cap, the compressed gas then passes through said check valves independently into said tubes.

4. The apparatus for sealing a hole according to claim 3, wherein said plug delivery means includes a conically-shaped folding pilot member connected to the end of said tubes opposite said plurality of check valves, said folding pilot member including a plurality of longitudinally extending plates, flexibly joined together, wherein said folding pilot member being deployed in the vicinity of the hole and being dragged through the hole.

5. The apparatus for sealing a hole according to claim 4, wherein said plug delivery means further includes a mobile probe having an axle and a pair of wheels mounted on said axle, wherein said plug is removably attached to said probe, said probe wheels rolling along the ship's hull to deploy said folding pilot member in the vicinity of the hole.

6. The apparatus for sealing a hole according to claim 5, wherein said plug delivery means further includes a pair of reversible motors coupled to said pair of wheels, a light source, video camera, and an electric/control line coupled to said mobile probe, said electric/control line providing power and control of said light source, said video camera and said pair of reversible motors, said electric/control line further transmitting a video signal from said video camera to the deck of the ship.

7. The apparatus for sealing a hole according to claim 6, wherein said pair of wheels include magnetic rims for securing said mobile probe to the metal hull, as said motors transport said mobile probe along the hull.

8. The apparatus for sealing a hull according to claim 7, wherein said plug further includes a liquid absorbent material disposed between said plurality of tubes, said liquid absorbent material expanding upon exposure to liquid to fill interstices between said tubes as said tubes are inflated.

9. The apparatus for sealing a hull according to claim 8, additionally including a mobile cart with a power source and a control source located on the deck of the ship for storing said plug, said plug delivery means and said means for inflating when not in use, said mobile cart being transportable to a location on the deck generally above the hole for deploying said plug and said plug delivery means in the vicinity of the hole, said mobile cart further housing said source of compressed gas and a power source and control source coupled to said electric/control line.

10. The apparatus for sealing a hole according to claim 1, wherein said plug delivery means including a longitudinally extending post with two ends disposed between said plurality of tubes having an arrow-shaped tip at one end thereof extending beyond said plurality of tubes and a handle at the other end, wherein said handle guides said arrow-shaped tip through the hole to create an opening for placing said tubes partially through the hole.

11. The apparatus for sealing a hole according to claim 10, wherein said handle has a hollow tube and said post has a flange at one end opposite said tip, said post being slidingly disposed within said hollow tube, said flange engaging said hollow tube to prevent removal of said post from said handle.

12. The apparatus for sealing a hole according to claim 11, wherein said handle is slid along said tube in a direction away from said tip and then slid along in the opposite direction to hammer said tip through said hole.

13. The apparatus for sealing a hole according to claim 12, wherein said plug further includes a cap and a plurality of check valves disposed on one end of each of said plurality of tubes, the ends of said plurality of tubes with said plurality of check valves is contained within said cap.

14. The apparatus for sealing a hole according to claim 13, wherein said plug further includes a flexible containment mesh attached to said cap and extending along the length of said plurality of tubes to flexibly contain said plurality of tubes.

15. The apparatus for sealing a hole according to claim 14, wherein said means for inflating includes a hose having two ends with one end operatively coupled to said cap, and a source of compressed gas located on a deck of the ship connected to the other end of said hose, wherein said means for inflating pumps compressed gas through said hose into said cap, the compressed gas then passes through said check valves independently into said plurality of tubes.

16. An apparatus for sealing a hole in a ship's hull comprising:

a plug having a plurality of longitudinally-extending, independently inflatable individual tubes, each tube having two ends, a check valve at one end, said tube being arranged parallel and adjacent to each other, said plug including an end cap for holding the other ends of said tubes;

plug delivery means for placing said tubes partially through the hole in the hull; and means for independently inflating said individual tubes through said check valves so that said tubes inflate and seal the hole.

* * * * *